US005511483A

United States Patent [19]

Griffin, Jr.

[11] Patent Number: 5,511,483

[45] Date of Patent: Apr. 30, 1996

[54] IDENTIFIABRE PROJECTIRE

[75] Inventor: Bennie Griffin, Jr., 11062 Traci Lynn Dr., Jacksonville, Fla. 32218

[73] Assignee: Bennie Griffin, Jr., Jacksonville, Fla.

[21] Appl. No.: 418,442

[22] Filed: Apr. 7, 1995

[51] Int. Cl.[6] ..... F42B 12/00

[52] U.S. Cl. ..... 102/501; 102/576; 102/517

[58] Field of Search ..... 102/293, 430, 102/501, 514, 515, 516, 517

[56] References Cited

U.S. PATENT DOCUMENTS

| | | | |
|---|---|---|---|
| 1,275,669 | 8/1918 | Forbes | 102/513 |
| 1,632,156 | 6/1927 | Wiley | 102/501 |
| 1,650,908 | 11/1927 | Ramsey | 102/430 |
| 1,887,324 | 11/1932 | Pocoroba | 102/501 |
| 2,592,434 | 4/1952 | Krasnow | 102/501 |
| 4,150,624 | 4/1979 | Hamond | 102/501 |
| 4,222,330 | 9/1980 | Krystyniak | 102/430 |

*Primary Examiner*—Harold J. Tudor

[57] ABSTRACT

An identifiable projectile is provided whereby an identification element is secured completely within the lead body of a projectile and remains engaged during ejection, flight, and impact.

2 Claims, 1 Drawing Sheet

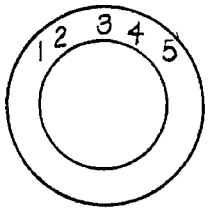
FIG. 1
FIG. 2
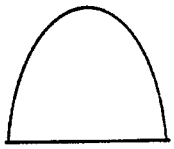
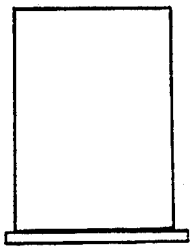
FIG. 3
FIG. 6
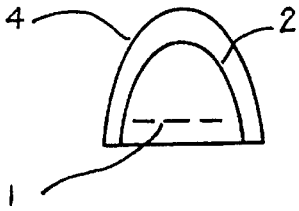
FIG. 4
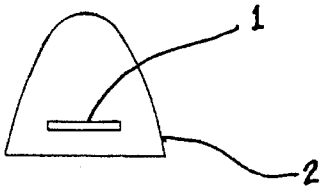
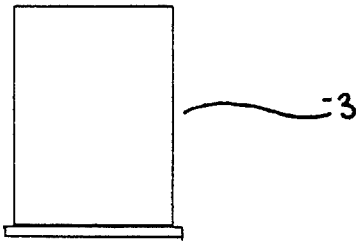
FIG. 5
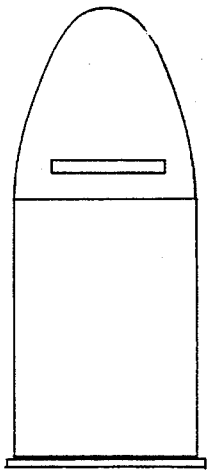

IDENTIFIABRE PROJECTIRE

BACKGROUND

My invention relates to an identifiable projectile. A projectile that provides information as to its purchaser which may aid in the apprehension of criminals. At present, projectiles are not manufactured with a means of identification secured in the projectile, leaving authorities with little or no clue as to the purchaser of the projectile.

The system of ballistics being used today, while effective in many cases, has an increasing smaller chance of deterring crime, as it requires the weapon that fired the projectile to be in possession of the tester. It also requires that the projectile be retrieved intact. With projectile designs of today, this is a difficult task. In addition, criminals of today are more apt to dispose of a used weapon and purchase another weapon illegally.

Today's advocates are fighting for tougher gun control measures and accountability. My invention is both a crime deterrent and an accurate method of projectile identification.

SUMMARY

The general object of my invention is to provide an identifiable projectile. This device consist of a conventional bullet of any caliber, to which a specific identification element in the form of an open centered washer made of metals or alloys of metal that have a melting point higher than that of the projectile and also having a specific identification insignia on it which is embedded near the base of the projectile and is completely invisible from the outside or bottom of the projectile. This would make it impossible to alter or tamper with the identification element unless projectile is destroyed or melted leaving projectile useless.

It is also the object of my invention to remain intact after being discharged from a fire arm and even after impact, leaving physical evidence in virtually every case which can aid authorities in apprehension of criminals and to some degree deter crime.

BRIEF DESCRIPTION OF DRAWINGS

FIG. 1 is an open centered washer with identification number stamped in.

FIG. 2 is a lead projectile.

FIG. 3 is a shell casing.

FIG. 4 is an identification washer (1) completely embedded inside of a lead projectile (2) and the shell casing (3) before assembling together.

FIG. 5 is an assembled version of FIG. 4.

FIG. 6 is a metal jacket (4) surrounding a lead body (2) wherein an open centered washer (1) which bears a specific identification insignia is completely embedded.

DESCRIPTION OF THE PREFERRED EMBODIMENT

In FIG. 1, there is shown an open centered washer bearing a specific identification insignia. Said washer is preferably made of metal or alloys of metal.

In FIG. 2, there is shown a solid lead projectile of any caliber having a substantially conical shape.

In FIG. 3, there is shown a cartridge for use in modern fire arms.

In FIG. 4, there is shown an open centered washer bearing a specific identification insignia (1) completely embedded in a lead projectile (2). Also shown in FIG. 4 is a shell casing (4) prior to its assembly with lead projectile (2) wherein an open centered washer bearing a specific identification insignia (1) is completely embedded.

In FIG. 5, there is shown the assembled version of FIG. 4.

In FIG. 6, there is shown a metal jacket (4) surrounding a lead body (2) wherein an open centered washer which bears a specific identification insignia (1) is completely embedded.

In FIGS. 4–6, said washer is placed in said lead projectile during casting of said projectile. Said washer is preferably smaller than said projectile in order to minimize any affect on the performance of the projectile. Said washer is completely embedded in the rear of the projectile near the base in order to make the washer less likely to fragment upon impact also making the washer tamper proof unless the projectile is destroyed.

I claim:

1. An identifiable projectile, substantially conical in shape having a solid lead body with a base which contains an identification element in the form of an open centered washer which bears a specific identification insignia thereon; said washer being made of material selected from the group consisting of metal or alloys of metal which has a higher melting point than that of said lead body; said washer is completely embedded within said lead body and is secured, parallel and adjacent to said base of said projectile thus allowing continuous engagement during ejection, flight, and impact; said washer remains totally invisible from any outer aspect and remains tamper proof unless the projectile is melted or destroyed leaving projectile useless.

2. The projectile of claim 1 wherein a metal jacket surrounds said projectile.

* * * * *